US005325675A

United States Patent [19]

Manz et al.

[11] Patent Number: 5,325,675

[45] Date of Patent: Jul. 5, 1994

[54] REFRIGERANT HANDLING SYSTEM AND METHOD WITH ENHANCED RECOVERY VACUUM CAPABILITY

[75] Inventors: Kenneth W. Manz, Paulding; Christopher M. Powers, Bryan, both of Ohio

[73] Assignee: SPX Corporation, Muskegon, Mich.

[21] Appl. No.: 100,425

[22] Filed: Aug. 2, 1993

[51] Int. Cl.[5] ..... F25B 45/00

[52] U.S. Cl. ..... 62/77; 62/292; 62/149

[58] Field of Search ..... 62/77, 149, 292, 100, 62/268

[56] References Cited

U.S. PATENT DOCUMENTS

| | | | |
|---|---|---|---|
| 3,699,781 | 10/1972 | Taylor . | |
| 4,285,206 | 8/1981 | Koser | 62/149 |
| 4,441,330 | 4/1984 | Lower et al. | 62/149 |
| 4,470,265 | 9/1984 | Correia . | |
| 4,540,353 | 9/1985 | Murray . | |
| 4,631,006 | 12/1986 | Murray . | |
| 4,805,416 | 2/1989 | Manz et al. . | |
| 4,981,020 | 1/1991 | Scuderi . | |
| 4,993,461 | 2/1991 | Yamane . | |
| 4,998,416 | 3/1991 | Van Steenburgh, Jr. . | |
| 5,086,630 | 2/1992 | Van Steenburgh, Jr. . | |
| 5,095,713 | 3/1992 | Laukhuf et al. . | |
| 5,099,653 | 3/1992 | Major et al. . | |
| 5,127,239 | 7/1992 | Manz et al. . | |
| 5,138,847 | 8/1992 | Rollins . | |
| 5,146,760 | 9/1992 | Paige . | |
| 5,170,632 | 12/1992 | Reilly, Jr. et al. . | |
| 5,172,562 | 12/1992 | Manz et al. . | |
| 5,193,351 | 3/1993 | Laukhuf et al. . | |
| 5,209,653 | 5/1993 | Murray et al. . | |
| 5,230,224 | 7/1993 | Ricketts et al. . | |

OTHER PUBLICATIONS

"How to Handle Multiple Refrigerants in Recovery and Recycling Equipment," ASHRAE Journal, Apr. 1991, pp. 22-30.

*Primary Examiner*—John M. Sollecito

*Attorney, Agent, or Firm*—Barnes, Kisselle, Raisch, Choate, Whittemore & Hulbert

[57] ABSTRACT

A refrigerant recovery system that includes a compressor having an inlet and an outlet, and an oil separator connected to the compressor inlet for separating oil from refrigerant recovered from equipment under service. A check valve is connected between a vapor outlet port on the oil separator and the inlet of the compressor for feeding refrigerant directly to the compressor inlet. A pressure sensor is connected to the oil separator for indicating refrigerant vapor pressure within the separator, and a valve is automatically responsive to such refrigerant vapor pressure for connecting a vacuum pump between the oil separator vapor port and the compressor inlet in parallel with the check valve when refrigerant vapor pressure at the oil separator falls below a predetermined value.

15 Claims, 1 Drawing Sheet

REFRIGERANT HANDLING SYSTEM AND METHOD WITH ENHANCED RECOVERY VACUUM CAPABILITY

The present invention is directed to refrigerant handling systems of the type that employ a compressor for pumping refrigerant through the system, and more particularly to a refrigerant recovery system and method with facility for boosting recovery vacuum obtainable by the compressor.

BACKGROUND AND SUMMARY OF THE INVENTION

It is conventional practice in systems for recovering refrigerant from equipment under service to employ a refrigerant compressor both for pumping the refrigerant from the equipment and drawing a vacuum at the equipment preparatory to recharging the equipment with fresh refrigerant. Such a system is shown, for example, in FIG. 5 of U.S. Pat. No. 4,805,416 assigned to the assignee hereof. Typically, refrigerant compressors are designed for air conditioning and refrigeration applications with specified design criteria for the compression ratio and pressure differential across the compressor. However, U.S. EPA regulations and guidelines regarding the final recovery vacuum obtainable by refrigerant recovery systems to prevent refrigerant mixing exceeds the design parameters of typical refrigerant compressors. Various techniques have been proposed for reducing the recovery system compression ratio or cooling the compressor, or for providing compressors of special design. However, such proposals are expensive and provide less than satisfactory results. It is therefore a general object of the present invention to provide a refrigerant handling system and method, and more specifically a refrigerant recovery system and method, that obtains improved recovery vacuum in the equipment under service while employing conventional components of proven capability and standard cost.

A refrigerant handling system in accordance with presently preferred embodiments of the invention includes a compressor having an inlet for connection to a source of refrigerant to be pumped. Such source may comprise refrigeration equipment from which refrigerant is to be recovered, or a refrigerant storage container from which refrigerant is to be pumped either to another container or to recharge evacuated refrigeration equipment. A vacuum pump is selectively connectable in series with the compressor during a latter portion of the pumping cycle to assist the compressor in removing all refrigerant from the refrigerant source while at the same time drawing a deeper vacuum at the source than would otherwise be obtainable using the compressor alone. In the preferred embodiments, a sensor or gauge is connected at the refrigerant inlet for indicating refrigerant pressure, and a valve is either automatically or manually responsive to inlet refrigerant pressure for connecting the vacuum pump to the refrigerant compressor when inlet refrigerant pressure falls below a selected level. Thus, for example, the refrigerant compressor may be employed alone for drawing refrigerant down to a pressure of one atmosphere (zero psig, 29.9 inches of mercury), and the vacuum pump then operatively connected in series with the compressor to assist the compressor in drawing a deeper inlet vacuum in the range of zero to twenty inches of mercury.

A refrigerant recovery system in accordance with the preferred embodiments of the invention includes a compressor having an inlet and an outlet, and an oil separator connected to the compressor inlet for separating oil from refrigerant recovered from equipment under service. A check valve is connected between a vapor outlet port on the oil separator and the inlet of the compressor for feeding refrigerant directly to the compressor inlet. A pressure sensor or gauge is connected to the oil separator for indicating refrigerant vapor pressure within the separator, and a valve is automatically or manually responsive to such refrigerant vapor pressure for connecting a vacuum pump between the oil separator vapor port and the compressor inlet in parallel with the check valve when refrigerant vapor pressure at the oil separator falls below a predetermined value.

BRIEF DESCRIPTION OF THE DRAWING

The invention, together with additional objects, features and advantages thereof, will be best understood from the following description, the appended claims and the accompanying drawing in which:

DETAILED DESCRIPTION OF PREFERRED EMBODIMENTS

Figure 1:
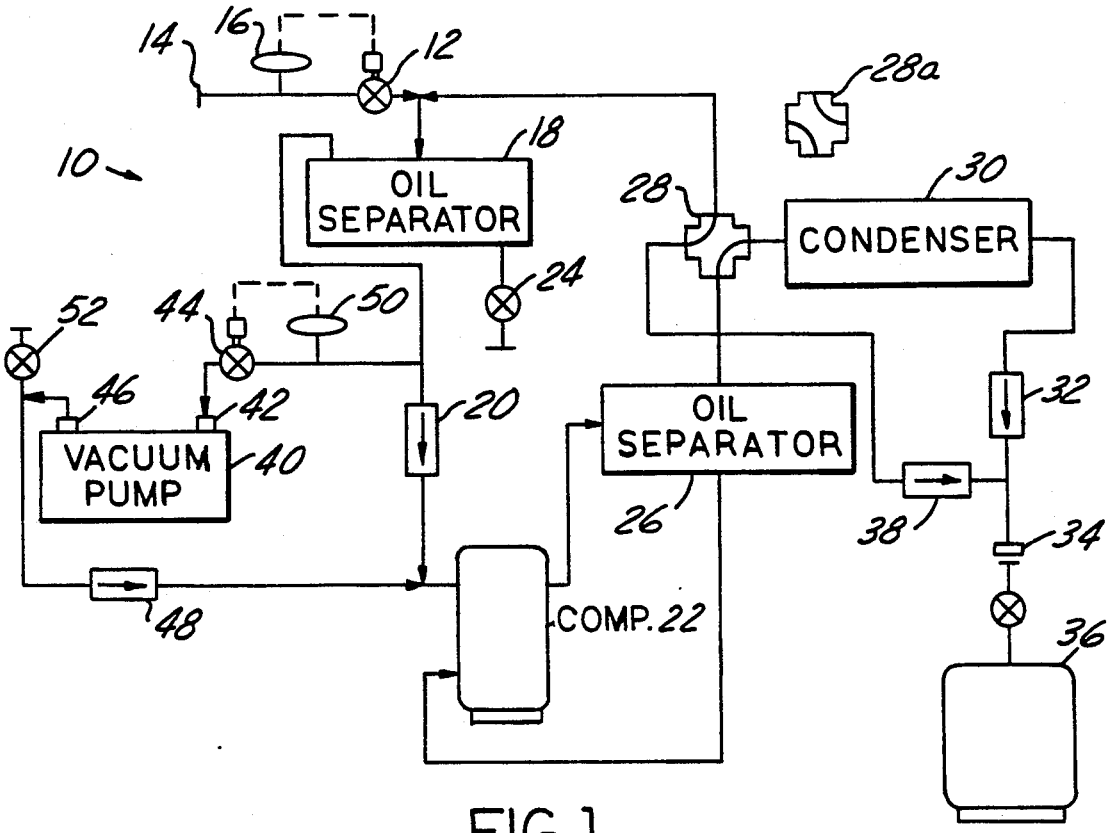
FIG. 1 is a schematic diagram of a refrigerant recovery system in accordance with one presently preferred embodiment of the invention.

FIG. 1 illustrates a refrigerant recovery system 10 in accordance with one presently preferred embodiment of the invention as comprising an inlet solenoid valve 12 connected to a coupling 14 for connection to a source of refrigerant such as refrigeration equipment from which refrigerant is to be recovered, or a refrigerant storage container from which refrigerant is to be pumped. A pressure sensor 16 is connected between valve 12 and coupling 14 for closing valve 12 and terminating a recovery operation when inlet refrigerant pressure falls below a selected vacuum level (at or below the vacuum level set by the EPA or other appropriate regulatory agency). Inlet refrigerant is fed from valve 12 to an oil separator 18 having a vapor port connected through a check valve 20 to the inlet of a refrigerant compressor 22. A drain port of separator 18 is connected to a valve 24 for selectively draining oil accumulated within the separator. The refrigerant outlet port of compressor 22 is connected through a compressor oil separator 26 and a clearing valve 28 to a condenser 30 for at least partially condensing refrigerant from compressor 22, and thence through a check valve 32 and a coupling 34 to a refrigerant storage container 36. Oil separator 26 is also connected to compressor 22 for returning oil to the compressor sump. Valve 28 has ports connected to the inlet port of oil separator 18, and through a check valve 38 to storage container coupling 34.

To the extent thus far described, with the exception of check valve 20, refrigerant recovery system 10 is of generally conventional construction as shown, for example, in U.S. Pat. No. 5,127,239 also assigned to the assignee hereof. In general, compressor 22 and valve 12 are initially operated to draw refrigerant from equipment under service into oil separator 18, in which oil in the refrigerant is separated from the refrigerant for later removal by means of valve 24. Inlet refrigerant vapor is drawn from separator 18 to compressor 22, and any liquid refrigerant trapped in the oil is boiled from the oil and drawn to the compressor inlet. Refrigerant is fed from compressor 22 through oil separator 26 and condenser 30 to storage container 36. Upon completion of a recovery operation, and when it is desired to clear the recovery system for use in conjunction with a different type of refrigerant, valve 28 is placed in the condition illustrated at 28*a*, at which condenser 30 is connected to inlet oil separator 18 in parallel with valve 12, and the compressor outlet is connected through oil separator 26 and thence through check valve 38 directly to container 36. Compressor 22 is then operated to draw any refrigerant vapor or liquid from condenser 30, with the same being fed directly to storage container 36. The disclosure of above-noted U.S. Pat. No. 5,127,239 is incorporated herein by reference for a more detailed description of the conventional portion of recovery apparatus 10 hereinabove discussed.

In accordance with the present invention, check valve 20 is connected between the vapor port of oil separator 18 and the inlet port of compressor 22 as noted above. A vacuum pump 40 has an inlet 42 connected through a solenoid valve 44 to the vapor port of oil separator 18, and an outlet 46 connected through a check valve 48 to the refrigerant inlet of compressor 22. Vacuum pump 40, valve 44 and check valve 48 are thus connected in parallel with check valve 20. A pressure sensor 50 is connected to the vapor port of oil separator 18 for controlling solenoid valve 44 as a function of refrigerant vapor pressure within the oil separator. That is, when such refrigerant vapor pressure within the oil separator drops to a level at which compressor 22 can no longer efficiently operate to pump refrigerant and boil refrigerant trapped in oil directly from the oil separator and/or the equipment under service, sensor 50 opens solenoid valve 44 so as to connect vacuum pump 40 in series between the oil separator vapor port and the compressor inlet, essentially short circuiting the direct path between the oil separator and compressor through check valve 20. Vacuum pump 40 may be powered continuously, or more preferably powered by pressure sensor 50 in parallel with valve 40. Vacuum pump 40 thereby assists and supplements the ability of compressor 22 to withdraw refrigerant from the oil separator and the equipment under service to a deeper vacuum level than is otherwise obtainable employing compressor 22 alone. Check valve 20 prevents vacuum pump 40 from drawing refrigerant from the compressor inlet, and check valve 48 functions to prevent vaporizing the vacuum pump beyond its design capability. Pressure sensor 50 may be set to open valve 44 at any suitable pressure to initiate the vacuum assist operation, such as a pressure of five inches of mercury vacuum. When refrigerant pressure at the equipment under services reaches the desired vacuum level sensed by sensor 16, such as fifteen inches of mercury specified by the U.S. EPA for R-12 refrigerant, the entire recovery operation may be terminated.

It will also be noted that vacuum pump 40 may be employed during the condenser clearing operation when valve 28 is in position 28*a*. The vacuum pump can be used to clear the system further down to a typical level of 1000 microns of mercury (0.02 psig) to minimize cross contamination of refrigerant types. A valve 52 is connected to vacuum pump outlet 46 for venting the vacuum pump outlet directly to atmosphere during the late stages of the clearing operation. Valve 52 may comprise a solenoid valve controlled by a second setpoint of pressure switch 50 or by a second pressure switch. That is, during the clearing mode of operation, compressor 22 is first operated alone to clear refrigerant from condenser 30. When refrigerant pressure from condenser 30 reaches the level of pressure switch 50, vacuum pump 40 is connected in series with compressor 22 to assist the compressor in clearing the condenser. Finally, vacuum pump 40 is vented through valve 52 to complete the clearing mode of operation. Vacuum pump 40 may be of any suitable conventional type, with those shown in U.S. Pat. Nos. 4,540,353, 4,631,006 and 5,209,653, all assigned to the assignee hereof, being exemplary.

Figure 2:
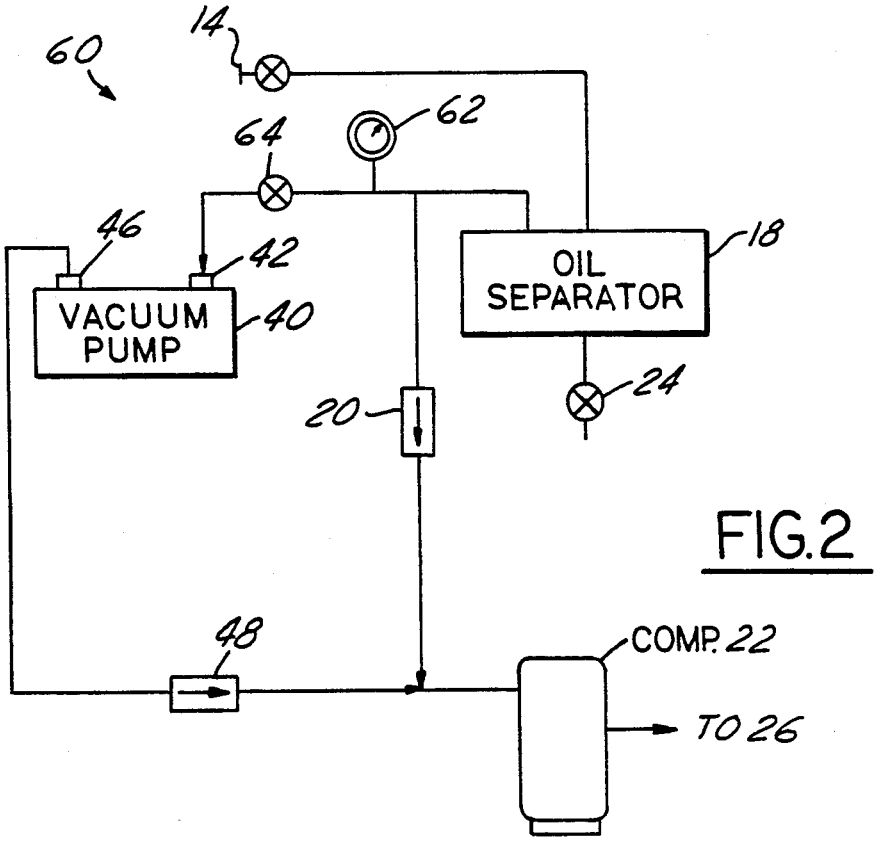
FIG. 2 is a fragmentary schematic diagram of a modification to the embodiment of FIG. 1.

FIG. 2 illustrates a modified embodiment 60 in accordance with the present invention in which the pressure sensor switch 50 and solenoid valve 44 in the embodiment of FIG. 1 are replaced by a gauge 62 coupled to the oil separator vapor port for indicating inlet refrigerant vapor pressure, and a manual valve 64 (or a solenoid valve and a manual switch) connected to vacuum pump inlet port 42 for connecting the vacuum pump in series with the compressor inlet when vapor pressure indicated at gauge 62 falls below the desired level. Power is applied manually to vacuumpump 40 in this embodiment when valve 64 is manually opened. That is, the embodiment 60 of FIG. 2 is essentially a manual version of the automatic embodiment 10 in FIG. 1.

The disclosed embodiments with oil separator 18 are particularly useful when inlet refrigerant is primarily in vapor phase. Where inlet refrigerant may be in liquid or mixed liquid/vapor phase, an evaporator may be employed either as part of or separate from oil separator 18. Such evaporator, where employed, oil separator 18 and condenser 30 may take the form of a combined heat-exchange/oilseparator unit as shown in above-noted U.S. Pat. No. 4,805,416. As shown in that patent, a refrigerant filter may be placed either at the outlet of oil separator 18 or the inlet of compressor 22, without affecting the principles of the present invention.

We claim:

1. In a refrigerant handling system that includes a compressor for pumping refrigerant and means for connecting an inlet of said compressor to a source of refrigerant to be pumped, the improvement wherein said inlet-connecting means comprises a vacuumpump and means responsive to refrigerant pressure at said inlet-connecting means for selectively connecting said vacuum pump in series with said compressor inlet for drawing a deeper vacuum at said inlet-connecting means than can be obtained by said compressor alone.

2. The system set forth in claim 1 wherein said selectively-connecting means comprises means for indicating refrigerant pressure at said inlet-connecting means, and means for connecting said vacuum pump in series with said compressor inlet when refrigerant pressure at said inlet-connecting means decreases to a selected level.

3. The system set forth in claim 2 wherein said pressure-indicating means comprises pressure sensor means for providing an electrical signal when refrigerant pressure at said inlet-connecting means decreases to a selected threshold, and valve means responsive to said electrical signal for connecting said vacuum pump in series with said compressor inlet.

4. The system set forth in claim 2 wherein said pressure-indicating means comprises a gauge for indicating refrigerant pressure to an operator, an wherein said inlet-connecting means comprises a valve responsive to manual input by an operator.

5. The system set forth in claim 1 wherein said inlet-connecting means comprises means connecting said compressor inlet to said refrigerant source in parallel with said vacuum pump for feeding refrigerant from said source to said compressor inlet when said vacuum Rump is not operating.

6. The system set forth in claim 5 wherein said parallel-connecting means includes a check valve.

7. The system set forth in claim 1 wherein said selectively-connecting means includes a check valve.

8. The system set forth in claim 1 further comprising means for connecting an outlet of said compressor to refrigerant storage means, including condenser means for at least partially condensing refrigerant between said compressor outlet and said storage means, and valve means for selectively disconnecting said condenser means from said compressor outlet and connecting said condenser means to said inlet-connecting means for clearing refrigerant from said condenser means.

9. The system set forth in claim 8 further comprising means for indicating refrigerant pressure in a clearing mode of operation, and means for connecting said vacuum pump in series with said compressor inlet when refrigerant pressure from said condenser means decreases to a first level of said clearing mode of operation.

10. The system set forth in claim 9 further comprising a vent valve operatively coupled to said vacuum pump for venting said vacuum pump to atmosphere when refrigerant pressure from said condenser means decreases to a second level, less than said first level, in said clearing mode of operation.

11. The system set forth in claim 1 wherein said inlet-connecting means further comprises means for preventing flow of liquid refrigerant to said compressor and vacuum pump.

12. The system set forth in claim 11 wherein means for preventing flow of liquid refrigerant comprises an oil separator having a vapor outlet port operatively connected to said compressor and said vacuum pump.

13. A refrigerant recovery system that comprises: a compressor having an inlet and an outlet; an oil separator for removing oil from refrigerant passing therethrough, said oil separator having an inlet for connection to a source of refrigerant to be recovered and a vapor port for removing refrigerant vapor from said separator; first means for feeding refrigerant from said vapor port to said compressor inlet; pressure measuring means coupled to said vapor port for indicating refrigerant vapor pressure at said vapor port; a vacuum pump; and valve means for connecting said vacuum pump between said vapor port and said compressor inlet in parallel with said first means when vapor pressure of refrigerant at said measuring means falls below a predetermined value.

14. The system set forth in claim 13 wherein said first means comprises a check valve.

15. A method of pumping refrigerant from a refrigerant source comprising the steps of:

(a) connecting a refrigerant compressor to said source so as to draw refrigerant vapor from said source until pressure of said refrigerant vapor falls to a preselected level, and then (b) connecting a vacuum Rump to said source in series with said compressor to assist said compressor in drawing refrigerant vapor from said source.

* * * * *